US007459035B2

(12) United States Patent
Imano et al.

(10) Patent No.: US 7,459,035 B2
(45) Date of Patent: Dec. 2, 2008

(54) STEAM TURBINE ROTOR AND STEAM TURBINE PLANT

(75) Inventors: Shinya Imano, Hitachi (JP); Hiroyuki Doi, Tokai (JP); Hirotsugu Kawanaka, Hitach (JP); Eiji Saitou, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 273 days.

(21) Appl. No.: 10/864,418

(22) Filed: Jun. 10, 2004

(65) Prior Publication Data

US 2004/0253102 A1 Dec. 16, 2004

(30) Foreign Application Priority Data

Jun. 13, 2003 (JP) ..... 2003-168578

(51) Int. Cl.
*C22C 19/05* (2006.01)
*C22C 30/00* (2006.01)

(52) U.S. Cl. ..... 148/410; 148/419; 420/447; 420/584.1

(58) Field of Classification Search ..... 420/446, 420/584.1, 447; 148/410, 419, 428, 442
See application file for complete search history.

(56) References Cited

U.S. PATENT DOCUMENTS 2,570,193 A * 10/1951 Walter et al. ..... 420/448
3,343,950 A * 9/1967 Edward et al. ..... 420/448
3,663,213 A * 5/1972 Elselstein et al. ..... 420/586.1
5,480,283 A * 1/1996 Doi et al. ..... 415/199.5
5,863,494 A * 1/1999 Nazmy et al. ..... 420/584.1
6,531,002 B1 3/2003 Henry et al.

FOREIGN PATENT DOCUMENTS

| | | |
|---|---|---|
| DE | 2525586 A * | 1/1976 |
| GB | 583162 | 12/1946 |
| GB | 583212 | 12/1946 |
| JP | 62-023949 | 1/1987 |
| JP | 10-226837 | 8/1998 |

(Continued)

OTHER PUBLICATIONS

"Mechanical Property and Microstructure of low Nb and High Al Ni-Fe Base Superalloy (IN706)", CAMP-ISIJ vol. 15(2002), p. 535.

*Primary Examiner*—Deborah Yee
(74) *Attorney, Agent, or Firm*—Dickstein Shapiro LLP

(57) ABSTRACT

To provide a rotor material preferable for a steam turbine of which main steam temperature is 675° C. or more, particularly exceeding 700° C., and a steam turbine plant having a rotor formed by the material, the invention provides a steam turbine plant including a very-high-pressure turbine of which steam inlet temperature is 675 to 725° C. and steam outlet temperature is 650° C. or less, a high-pressure turbine, and a medium-low-pressure turbine, wherein a rotor of the very-high-pressure turbine is formed from a forged material of NiFe-base alloy containing: 14 to 18 weight % Cr, 15 to 45 weight % Fe, 1.0 to 2.0 weight % Al, 1.0 to 1.8 weight % Ti, C and N of which the sum is 0.05 or less weight %, and Nb in the range specified by the formula: 3.5−(Fe weight %)/20< (Nb weight %)<4.5−(Fe weight %)/20.

4 Claims, 5 Drawing Sheets

FOREIGN PATENT DOCUMENTS

| | | | | |
|---|---|---|---|---|
| JP | 10 226837 | A | | 8/1998 |
| JP | 410226837 | | * | 8/1998 |
| JP | 2000-273597 | A | | 10/2000 |
| JP | 2000-282808 | A | | 10/2000 |
| JP | 2000-303802 | A | | 10/2000 |
| JP | 2001-082109 | A | | 3/2001 |
| JP | 2002-256814 | A | | 9/2002 |
| JP | 2003-518220 | A | | 6/2003 |

* cited by examiner

STEAM TURBINE ROTOR AND STEAM TURBINE PLANT

BACKGROUND OF THE INVENTION

The present invention relates to a rotor of a steam turbine of which main steam temperature is 675° C. or more, and to a steam turbine plant.

For improving power generating efficiency of a steam turbine power generation plant, it is effective to increase its main steam temperature. At present, a steam turbine plant of which main steam temperature is more than 600° C. is commercially operated, and a steam turbine of which main steam temperature is of the 650° C. class is under development. Moreover, in order to further improve the efficiency, a steam turbine of which main steam temperature is 675° C. or more, and particularly 700° C. or more is also under development. In the steam turbine aiming at the main steam temperature of 700° C. or more, a conventional rotor material made of steel is not suitable since its allowable temperature is approximately 650° C., and thus, it is necessary to produce the rotor from Ni-base alloy. The Ni-base alloy has higher strength in comparison with the steel material, however, the Ni-base alloy is expensive, and moreover, it is difficult to make a large forged product from the Ni-base alloy. As an alloy from which the large forged product is relatively easily produced, there are raised an A286-type alloy, an IN706-type alloy, an IN718-type alloy and the like. These alloys have been adopted in a gas turbine disk and a power generator rotor for example, as shown in JP-A-10-226837 (the claims) and a non-patent document of CAMP-ISIJ VOL. 15 (2002)-535 (preamble).

BRIEF SUMMARY OF THE INVENTION

The A286-type alloy is advantageous in cost because it contains a relatively large amount of Fe as NiFe-base alloy. However, the A286-type alloy is poor in strength and thus not suitable for a steam turbine rotor material of which main steam temperature is 700° C. or more. The IN706-type alloy is advantageous in cost because it is superior in balance of large steel ingot manufacturing property and strength, and contains about 40 weight % of Fe. The IN718-type alloy contains a lot of segregation elements such as Nb and Mo, and thus it is difficult to make a steam turbine rotor exceeding 10 ton using the IN718-type alloy. However, the high-temperature strength of the IN718-type alloy is superior to that of the IN706-type alloy. In view of these facts, the present invention aims at developing a steam turbine plant of which main steam temperature is 675° C. or more, and particularly 700° C. or more, and of which a very-high-pressure turbine rotor is made from the NiFe-base alloy such as an IN706-type alloy and an IN718-type alloy.

The NiFe-base alloy such as an IN706-type alloy and an IN718-type alloy is a typical gas-turbine disk material. However, since the NiFe-base alloy causes a solidification defect (freckle defect) due to segregation of Nb, it is difficult to make a forged product exceeding 10 ton from the NiFe-base alloy. For improving the manufacturing property of the large steel ingot, it is effective to reduce Nb which is a segregation element. However, since the NiFe-base alloy is precipitation-strengthened by $Ni_3Nb$ (γ" phase), the strength thereof is deteriorated if reducing Nb.

Further, while the NiFe-base alloy shows a superior mechanical characteristic at 500 to 650° C., it has been hardly operated approximately at 700° C. As a result of investigation by the inventors, it becomes apparent that a harmful phase is precipitated when the NiFe-base alloy is subjected to 700° C. for a long time, so that the NiFe-base alloy is weakened.

As described in the above, in the case of manufacturing a steam turbine of which main steam temperature is 675° C. or more, particularly over 700° C., there has been the big problem with respect to the manufacturing property and high-temperature stability of the rotor material.

Accordingly, it is an object of the invention to develop a rotor material preferable for a steam turbine of which main steam temperature is 675° C. or more, particularly higher than 700° C., and to provide a rotor formed by the material and a steam turbine plant provided with the rotor.

The steam turbine rotor of the invention is made from a forged material of NiFe-base alloy including: 14 to 18 weight % Cr; 15 to 45 weight % Fe; 1.0 to 2.0 weight % Al; 1.0 to 1.8 weight % Ti; C and N of which the sum is 0.05 or less weight %; and Nb within the range specified by the following formula:

$$3.5-(\text{Fe weight }\%)/20<(\text{Nb weight }\%)<4.5-(\text{Fe weight }\%)/20.$$

The invention is characterized by using the rotor made of the above-described NiFe-base alloy forged material as a rotor of a steam turbine plant comprising a very-high-pressure turbine of which steam inlet temperature is 675 to 725° C. and of which steam outlet temperature is 650° C. or less, a high-pressure turbine, and a medium-low-pressure turbine. The rotor of the invention can be used for any one of a very-high-pressure-turbine rotor, a high-pressure turbine rotor, and a medium-low-pressure turbine rotor. However, it is particularly preferable to use the rotor of the invention as a very-high-pressure-turbine rotor.

The inventors have investigated the relation between the high-temperature strength and the structure of the IN706-type alloy. In JP-A-10-226837, in order to improve the fatigue strength and the toughness of the IN706-type alloy, it is attempted to increase the added amounts of C and N and increase a precipitation quantity of NbC to fine crystal grains to improve the characteristics. In this case, since Nb of $Ni_3Nb$ serving as a precipitation enhancement phase is taken by NbC, $Ni_3Nb$ is decreased so that the 0.2% yield strength and the like are deteriorated. However, JP-A-10-226837 describes that the deterioration of the strength can be compensated by adding Al to precipitate $Ni_3Al$ serving as a precipitation enhancement phase in a single-crystal Ni-base alloy or the like. Further, the non-patent document of CAMP-ISIJ VOL. 15 (2002)-535 reports that $Ni_3Al$ precipitated by adding Al is stable at 700° C., as a result of studying a part of the structure of the alloy described in JP-A-10-226837. Since JP-A-10-226837 is directed to a disk material of a gas turbine which is operated at low temperature and is frequently stopped and started, it is considered therein that the fatigue strength is important, so that the added amounts of C and N are increased to fine the crystal grains. However, in the case of a steam turbine rotor, it is considered that the creep strength is more important than the fatigue strength since the operated temperature is higher and the stop-start frequency is lower, in comparison with those of the gas turbine. Although the fatigue strength is more improved as the crystal grains are made smaller, the creep strength is deteriorated by fining the crystal grains. Further, it is not preferable that the precipitation quantity of $Ni_3Nb$ is decreased due to the precipitation of NbC. Thus, it is more advantageous that the added amounts of C and N are smaller in the case of the steam turbine rotor material.

According to the academic study in the non-patent document of CAMP-ISIJ VOL. 15 (2002)-535, it is effective for structural stability in high-temperature and strength improvement in high-temperature that the content amounts of Al and Nb are on a higher side and on a lower side, respectively, within the ranges of the content amounts of Al and Nb as described in JP-A-10-226837. However, the non-patent document does not mention proper added amounts of the other elements, particularly of C and N. Also, the added amount of Fe is constant therein.

On the basis of the knowledge by JP-A-10-226837 and the non-patent document of CAMP-ISIJ VOL. 15 (2002)-535, the inventors have placed a high value on the creep strength necessary for a steam turbine rotor material and on the freckle defect suppression by reducing Nb, and have particularly improved the added amounts of C and N. Also, the inventors have paid attention to the added amounts of Fe, and have found that the NiFe-base alloy which contains 14 to 18 weight % of Cr, 15 to 45 weight % of Fe, 1.0 to 2.0 weight % of Al, 1.0 to 1.8 weight % of Ti, 0.05 weight % or less of the sum of C and N, and a predetermined amount of Nb is suitable for a steam turbine rotor material of which main steam temperature is 675° C. or more, particularly over 700° C.

Hereinafter, reasons why the composition range of the NiFe-base alloy according to the invention is restricted are described.

Regarding Al, it is necessary that the NiFe-base alloy contains 1.0 weight % or more of Al to compensate the deterioration of the strength due to decreasing of Nb and to improve the structural stability. However, if the content amount thereof is excessive, $Ni_3Al$ is increased excessively to cause the deterioration of the forging property. Thus, it is preferable that the content amount of Al is 2.0 weight %.

Regarding Ti, because Ti also serves as an element precipitating $Ni_3Al$ and as an element stabilizing $Ni_3Ti$, it is not preferable to add Ti excessively, but it is preferable that the NiFe-base alloy contains 1.0 to 1.8 weight % of Ti.

Regarding C and N, as described in the above, it is preferable that the NiFe-base alloy contains 0.05 weight % or less of the sum of C and N, in order to prevent the crystal grains from being fined (downsized) in accordance of increasing of NbC.

The added amount of Nb is preferably 3 weight % or less, in order to suppress segregation. In addition, in order to suppress precipitation of an η-phase, a σ-phase, and a δ-phase which are harmful phases, the content of Fe must satisfy the flowing formula:

$$(\text{Nb weight \%}) < 4.5 - (\text{Fe weight \%})/20.$$

Further, because Nb is an element precipitating a γ'-phase also, if the content of Nb is too low, it is impossible to obtain effective strength. Therefore, the content amount of Fe must satisfy also the following formula.

$$3.5 - (\text{Fe weight \%})/20 < (\text{Nb weight \%}).$$

The element other than the above described elements is substantially Ni.

By using the NiFe-base alloy having the component range as described in the above, it is possible to manufacture a very-high-pressure turbine rotor superior in the high-temperature strength and the high-temperature stability, whereby the freckle defect is hardly generated even if the rotor is produced through a dissolving process and a hot forging process, and any harmful phase is not precipitated even when using the rotor for a long time.

Other objects, features and advantages of the invention will become apparent from the following description of the embodiments of the invention taken in conjunction with the accompanying drawings.

DETAILED DESCRIPTION OF THE INVENTION

Figure 1:
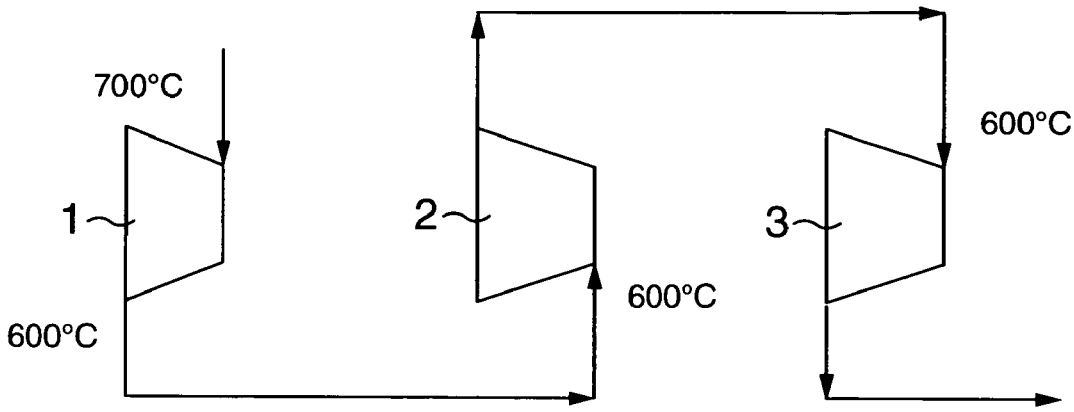
FIG. 1 is an illustration showing a configuration of a steam turbine.

FIG. 1 is a schematic view of a steam turbine plant showing an embodiment of the invention. The steam turbine plant is constituted by a very-high-pressure turbine 1, a high-pressure turbine 2, and a medium-low-pressure turbine 3. The inlet steam temperature of the very-high-pressure turbine 1 is 700° C. and the outlet steam temperature thereof is 600° C. The inlet steam temperature of both the high-pressure turbine 2 and the medium-low-pressure turbine 3 is 600° C. Chemical components of a material used for the very-high-pressure turbine 1 are shown in Table 1. Table 2 shows a configuration of rotors manufactured.

TABLE 1

Chemical components of experimental rotor materials (wt. %)

| | Fe | Cr | Nb | Mo | Al | Ti | C | N | Ni |
|---|---|---|---|---|---|---|---|---|---|
| Alloy 1 | 35 | 14 | 3 | 0 | 0.2 | 1.6 | 0.03 | <.001 | Residual |
| Alloy 2 | 15 | 14 | 5 | 3 | 0.5 | 1.0 | 0.03 | <.001 | Residual |
| Alloy 3 (Invented material A) | 35 | 14 | 2 | 0 | 1.25 | 1.6 | 0.03 | <.001 | Residual |
| Alloy 4 (Invented material B) | 15 | 14 | 3 | 0 | 1.3 | 1.6 | 0.03 | <.001 | Residual |

TABLE 2

Materials and configurations of very-high-pressure rotors

| | Rotor material | Rotor configuration | Forged product weight | Presence of freckle defect |
|---|---|---|---|---|
| Case A | Alloy 1 | Integrated | 12 ton | Yes |
| Case B | Alloy 2 | Integrated | 8 ton | Yes |
| Case C | Alloy 1 | Two parts Bolt connected | 6 ton/piece | No |
| Case D | Alloy 3 | Integrated | 12 ton | No |
| Case E | Alloy 4 | Integrated | 8 ton | No |

In case A using a conventional material, a freckle defect is generated at the central portion of the rotor due to segregation. In case B, although the weight of the rotor is decreased to be 8 ton to downsize the rotor, a freckle defect is generated similarly to case A. In case C, the rotor is divided into two parts, which are connected by a bolt. In this case, since the size of the forged product is small, no freckle defect is generated. In case D and case E according to the invention, no freckle defect is detected despite having an integrated structure.

Hereinafter, there are shown results of mechanical tests and metallographic structure observations performed by sampling test pieces from the rotors of cases C to E in which no freckle defect is generated.

Figure 2:
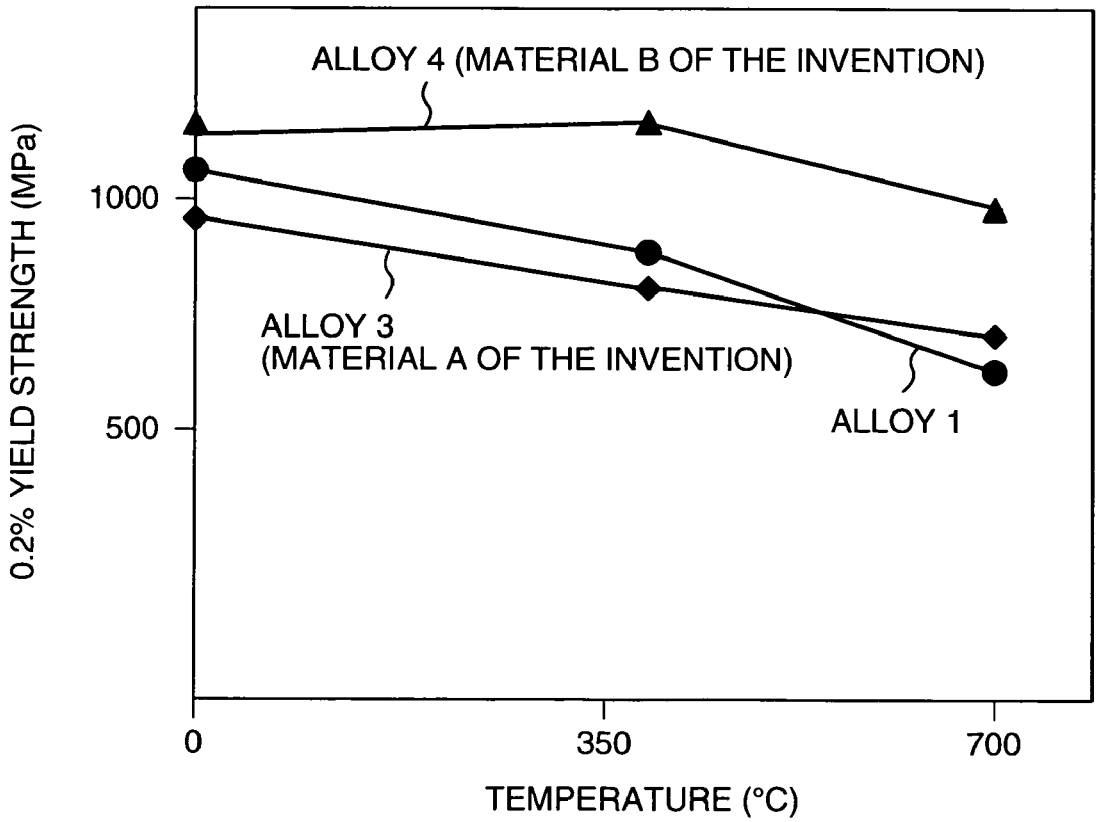
FIG. 2 is an illustration showing a result of a tensile test of steam turbine rotor sample materials.
Figure 3:
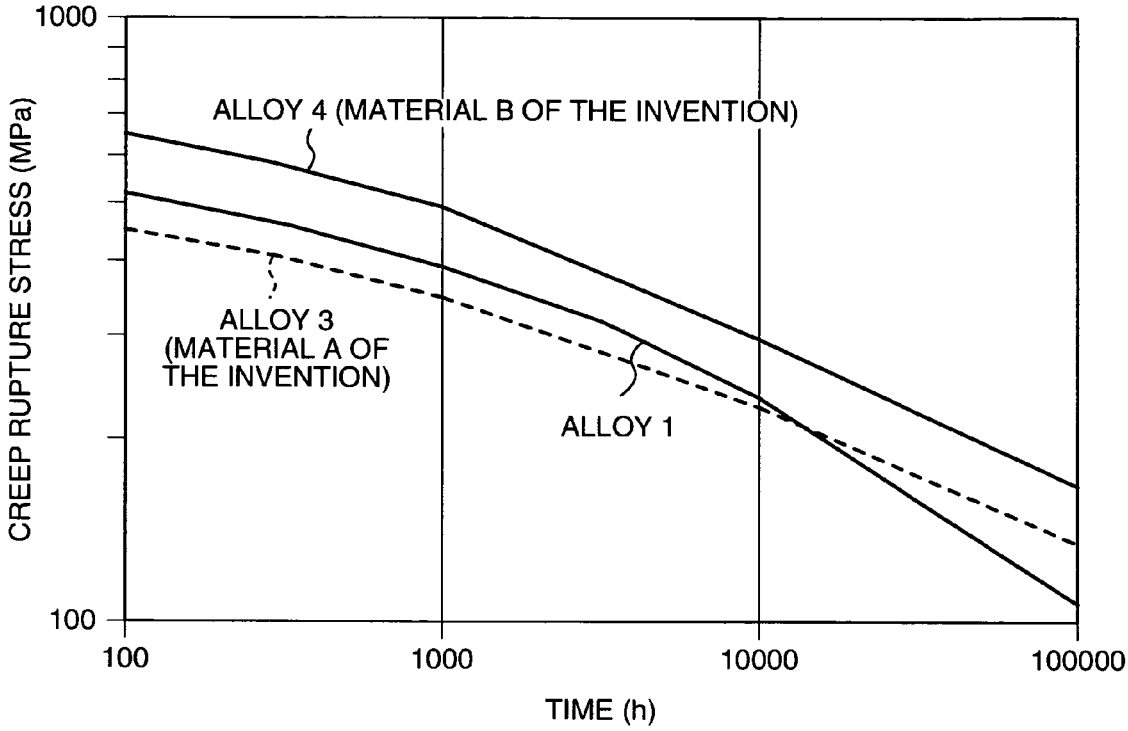
FIG. 3 is an illustration showing a result of a creep test of steam turbine rotor sample materials.

FIG. 2 shows results of a tensile test of the rotor sample materials. Although the conventional material is superior in yield strength at room temperature, the sample materials from the rotors using the materials of the invention are superior in yield strength and tensile strength at approximate 700° C. FIG. 3 shows creep test results of the rotor sample materials. The creep strengths of the rotor sample materials using the materials of the invention are is equal to or more than that of the conventional material.

Figure 4:
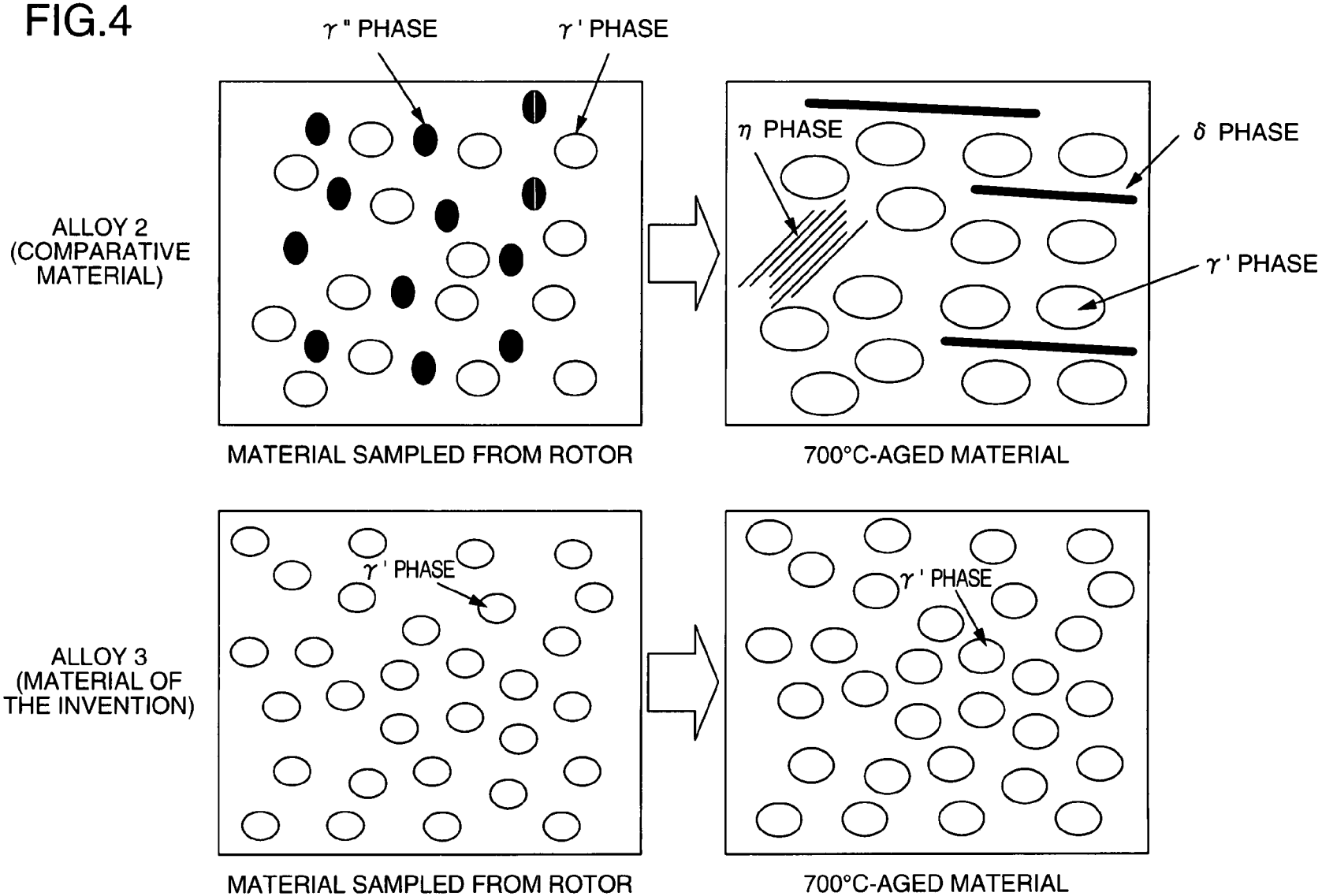
FIG. 4 is an illustration showing sketches of metallographic structures of steam turbine rotor sample materials and aged materials thereof.

FIG. 4 shows sketches of metallographic structures of the above rotor materials and the aged materials thereof, which was aged at 700° C. for 5,000 hours. A transmission electron microscope is used to observe the metallographic structures. In the case of a sample rotor material according to a conventional material, a γ' phase ($Ni_3Al$) and a γ" phase ($Ni_3Nb$) are finely distributed. However, in the case of a sample material according to the material of the invention, the sludge precipitated in crystal grains is only the γ' phase ($Ni_3Al$). In the case of the sample which is made by subjecting the sample rotor material according to the conventional material to the aging process at 700° C., a layered η-phase and a layered δ-phase are observed, the γ' and γ" phases are macroaggregated, and the precipitated quantity is decreased. In the case of the rotor material using the material of the invention, the η-phase and the δ-phase are not precipitated even after the aging at 700° C., and only the γ' phase is precipitated in grains.

Figure 5:
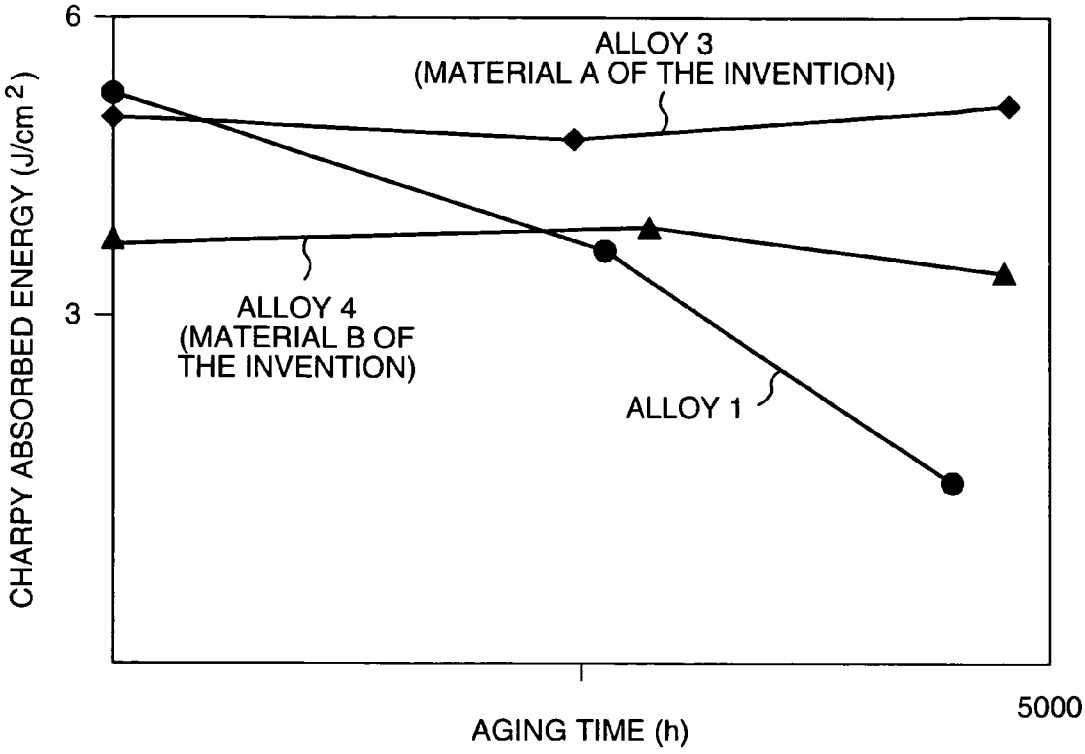
FIG. 5 is an illustration showing a result of a Charpy impact test of steam turbine rotor sample materials and aged materials thereof.

FIG. 5 shows a Charpy impact test result of the rotor sample materials and the materials obtained by subjecting the rotor sample materials to the aging process as 700° C. In the case of the rotor material using the conventional material, the Charpy absorbed energy is considerably lowered due to the aging at 700° C. which is a working temperature. However, in the case of the material of the invention, the lowering of the Charpy absorbed energy is shown.

As described in the above, the material of the invention is characterized in that an initial precipitation enhancement phase is only the γ' phase, and a harmful phase such as η and δ phases is not produced even when aging the material of the invention at 700° C. for a long time. Thus, the material of the invention is not weakened even when aging it at 700° C. In addition, in the case of the conventional material as shown in FIG. 2, the tensile strength thereof is considerably deteriorated from a room temperature to a high temperature. The reason why the strength of the material of the invention is not so deteriorated is that it has only the γ' phase as a precipitation enhancement phase, which γ' phase has a special characteristic that the higher the temperature is, the more the strength is increased.

Figure 6:
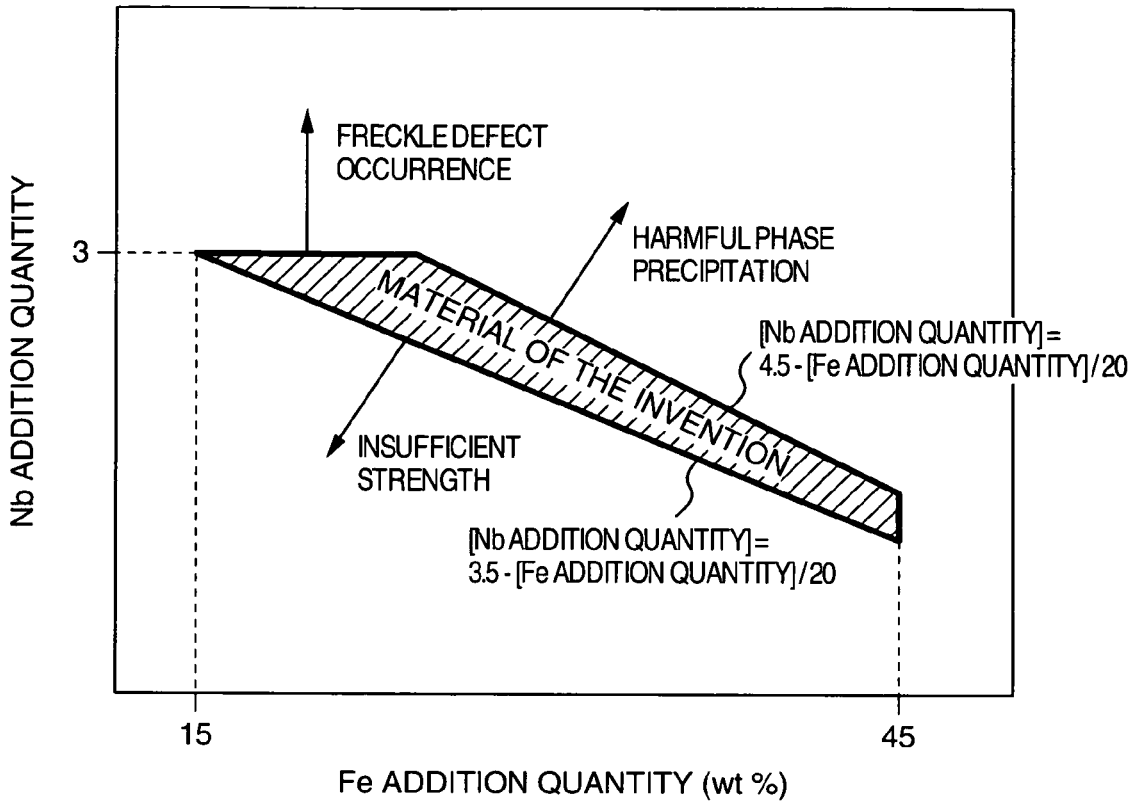
FIG. 6 is an illustration showing an appropriate composition range of Ni-base alloy used for a rotor of the invention.

FIG. 6 shows a result of studying a composition range in which an proper quantity of the γ' phase, which is stable even at a high temperature and superior in high-temperature strength, is precipitated, no harmful phase is not precipitated, and no freckle defect is produced when manufacturing a large steel ingot. By manufacturing a rotor material within the composition range, it is possible to manufacture a 10 ton class steam turbine rotor superior in high-temperature strength and in weakening property at approximate 700° C.

The present invention makes it possible to manufacture a steam turbine rotor of 10 ton class superior in high-temperature strength and in weakening characteristic at 675° C. or more, particularly at approximate 700° C.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A rotor of a steam turbine of which main steam temperature is 675° C. or more, wherein the rotor weighs 8 ton or more and is made from a forged material of NiFe-base alloy consisting of:

Cr of 14 to 18 weight %;

Fe of 15 to 45 weight %;

Al of 1.0 to 2.0 weight %;

Ti of 1.0 to 1.8 weight %;

C and N of which the sum is 0.05 or less weight %;

Nb within the range defined by the formula;

3.5−(Fe weight %)/20<(Nb weight)<4.5−(Fe weight %)/20; and the balance essentially Ni;

wherein a γ' phase is precipitated in the NiFe-base alloy, the γ' phase being $Ni_3A1$; and wherein the NiFe-base alloy does not contain γ" phase.

2. The steam turbine rotor according to claim 1, wherein the upper limit amount of Nb is 3 weight %.

3. A steam turbine plant comprising a very-high-pressure turbine of which steam inlet temperature is between 675 and 725° C. and of which steam outlet temperature is 650° C. or less, a high-pressure turbine, and a medium-low-pressure turbine, wherein a rotor of the very-high-pressure turbine weighs 8 ton or more and is made from a forged material of NiFe-base alloy consisting of:

Cr of 14 to 18 weight %;

Fe of 15 to 45 weight %;

Al of 1.0 to 2.0 weight %;

Ti of 1.0 to 1.8 weight %;

C and N of which the sum is 0.05 or less weight %;

Nb within the range defined by the formula;

3.5−(Fe weight %)/20<(Nb weight %)<4.5−(Fe weight %)/20; and the balance essentially Ni;

wherein a γ' phase is precipitated in the NiFe-base alloy, the γ' phase being $Ni_3Al$; and wherein the NiFe-base alloy does not contain γ" phase.

4. The steam turbine rotor plant according to claim 3, wherein the upper limit amount of Nb is 3 weight %.

* * * * *